United States Patent [19]

Qureshi

[11] 4,071,189

[45] Jan. 31, 1978

[54] SLIDE RULE CURSOR

[76] Inventor: Faiz Mohammad Qureshi, 10456-19th South, Seattle, Wash. 98168

[21] Appl. No.: 615,395

[22] Filed: Sept. 22, 1975

[51] Int. Cl.[2] ..... G06G 1/02

[52] U.S. Cl. ..... 235/70 B; 235/61 GM; 235/70 R; 235/70 C

[58] Field of Search ..... 235/61 GM, 70 R, 70 A, 235/70 B, 70 C; 33/15 D, 76 V

[56] References Cited

U.S. PATENT DOCUMENTS

| | | | |
|---|---|---|---|
| 1,014,344 | 1/1912 | Smith | 235/70 B |
| 2,326,413 | 8/1943 | Thompson | 235/70 A |
| 2,385,948 | 10/1945 | Setera | 235/70 B |
| 2,585,595 | 2/1952 | Spencer | 235/70 R |
| 2,892,586 | 6/1959 | Graham | 235/61 GM |
| 3,784,093 | 1/1974 | Bennett | 235/70 A |

FOREIGN PATENT DOCUMENTS

| | | | |
|---|---|---|---|
| 829,868 | 3/1960 | United Kingdom | 235/70 R |

*Primary Examiner*—E. S. Jackmon

[57] ABSTRACT

A slide rule cursor which is adapted for use with conventional slide rules to provide direct resolution of the resultant value of parallel and/or series impedances. The cursor is not only movable axially along the body of the slide rule in a conventional manner but is also movable perpendicularly to the axial direction of the body of the slide rule. The cursor has printed on it a series of curves from which unique values of a special coefficient referred to as $\mu_\theta$ may be readily obtained for each network of parallel and/or series impedances. This value of $\mu_\theta$ relates the individual impedances in the network through a series of relationships discovered by the inventor to the resultant value of impedance and its angle.

6 Claims, 17 Drawing Figures

SLIDE RULE CURSOR

BACKGROUND OF THE INVENTION

This invention relates to the art of cursors for slide rules, particularly lineal slide rules.

The design of electrical circuits or power line networks for utilities frequently requires the resolution of complex networks of series and parallel impedances into resultant impedances. In some cases, one or more of the impedances in the circuit or power line network under consideration may be purely resistive, in which case the circuit analysis is significantly simplified. However, circuit impedances are commonly a complex mixture of resistance and reactance, a result of resistive, capacitive and inductive elements. In instances where the impedance of an element or network includes capacitive and/or inductive reactance portions, the impedance will include an imaginary component, and will be expressed in trigonometric vector form as R+JX, where R represents the real portion and JX the imaginary portion of the impedance. This trigonometric vector term R+JX may be converted into a corresponding phasor vector by squaring the portions of the trigonometric vector term, and then taking the square root of the sum of the squared portions. The phasor vector is expressed as $Z/\theta$, where Z corresponds to the quantity of the impedance, and $\theta$ corresponds to the angle of the phasor vector. These vector relationships are conventional and are illustrated in FIG. 1. FIG. 1 shows the relationship between the trigonometric vector form of an impedance of R+JX and the phasor vector form $Z/\theta$. The phasor vector term is a single part resultant of the two-part trigonometric vector term R+JX.

The resolution of complex series and/or parallel impedances into a resultant impedance requires a significant number of laborious hand operations. This is particularly when the resultant of two parallel impedances is to be found. The resultant of two parallel impedances is found by the following formula: $1/Zp/\theta p = 1/Z_1/\theta_1 + 1/Z_2/\theta_2$. Typically, the solution of two parallel impedances can take more than thirty separate operations in order to obtain the correct values of $Z_p$ and $\theta_p$, while a somewhat fewer number of operations are necessary to solve for the resultant of two series impedances. There are, of course, almost an infinite number of possible combinations of impedances, and hence, no tables are available for conveniently ascertaining the resultant of series or parallel impedances.

As a practical measure, the hand calculations in such instances are not made in their entirety but rather, an estimate is made as to the resultant values of Z or $\theta$. Such a practice, although almost necessary as a practical measure, is undesirable, as it can lead to significant errors in the determination of resultant circuit impedance.

From the foregoing, it is a general object of the present invention to provide a slide rule cursor adapted for use with conventional slide rules to solve the problems in the art discussed above.

It is a further object of the present invention to provide such a slide rule cursor which can be used to determine the resultant Z and $\theta$ of parallel and/or series impedances in a relatively simple manner.

It is another object of the present invention to provide a slide rule cursor by which the resultant of series and/or parallel impedances may be obtained entirely by slide rule operations.

It is a still further object of the present invention to provide such a slide rule cursor which can also be used to solve conventional mathematical problems, It is a further object of the present invention to provide such a slide rule cursor which is similar in size to conventional slide rule cursors.

SUMMARY OF THE INVENTION

Accordingly, the present invention is a slide rule cursor which is useful in operation relative to a selected scale on a slide rule to determine a vector coefficient which in turn is useful to determine the series or parallel resultant of two complex impedances which are known and expressed as phasor vectors, and wherein the absolute angular difference between said two complex impedences is defined as $\theta$, and the ratio of their magnitude as $\rho$.

The slide rule cursor includes a substantially transparent cursor face plate having visible on one surface thereof at least one curve which is defined relative to first and second coordinate axes on said one surface, said first coordinate axis representing values of the vector coefficient and being related to said selected scale on the slide rule, said second axis representing values of $\rho$, said curve identifying a range of coefficients corresponding to a range of values of $\rho$ and a preselected fixed value of $\theta$. The cursor further includes a cursor frame adapted to hold said cursor face plate in position relative to said slide rule so that said cursor is slidable axially along said slide rule, said cursor frame including means adapted to permit movement of said face plate transversly of the axial direction of said slide rule. The positioning of the slide rule cursor relative to said selected scale on the slide rule in accordance with the values of $\theta$ and $\rho$ of said two complex impedances results in the correct value of the vector coefficient for said two complex impedances being ascertained by the operator, permitting thereby rapid calculation of the resultant of said two complex impedances.

DESCRIPTION OF PREFERRED EMBODIMENT

Figure 3:
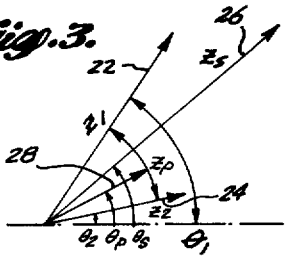
FIG. 3 is a phasor vector diagram showing the resultant phasor vectors for both the series and parallel resultants of $Z_1/\theta_1$ and $Z_2/\theta_2$, where $Z_1$ is larger than $Z_2$ and $\theta_1$ is larger than $\theta_2$.

Referring to FIG. 3, two complex impedance are represented by two phasor vectors 22 and 24, phasor vector 22 being shown as $Z_1/\theta_1$ and phasor vector 24 being shown as $Z_2/\theta_2$. In this example, $Z_1$ is larger than $Z_2$ and $\theta_1$ is greater than $\theta_2$. The series resultant of phasor vectors 22 and 24 is shown in FIG. 3 as phasor vector 26 ($Z_s/\theta_s$), while the parallel resultant is shown as phasor vector 28 ($Z_p/\theta_p$).

The actual values of $Z_s/\theta_s$ may be ascertained either by a series of hand calculations, or by geometry, as will be demonstrated in following paragraphs. $Z_p/\theta_p$, the resultant of parallel impedances, however, can only be ascertained by hand calculations, and hence, an accurate solution thereof is extremely time-consuming.

The present inventor has, however, discovered a coefficient, referred to throughout this application as $\mu_\theta$, which relates the known Z and $\theta$ portions of the constituent impedances $Z_1/\theta_1$, $Z_2/\theta_2$ by means of simple formula relationships developed by the inventor to the unknown values of $Z_s/\theta_s$ and $Z_p/\theta_p$. Each combination of $Z_1/\theta_1$ and $Z_2/\theta_2$ has a unique coefficient $\mu_\theta$, and once this coefficient is ascertained by use of the inventor's new slide rule cursor, the actual values of $Z_s/\theta_s$ and $Z_p/\theta_p$ may be readily ascertained from the known formulas, eliminating the laborious hand or drawing operations previously required.

The theoretical basis of $\mu_\theta$ and its relationship to $Z_p/\theta_p$ and $Z_s/\theta_s$ will be explained in detail in following paragraphs, but for purposes of immediate explanation and understanding of the concept of the coefficient $\mu_\theta$, the relationships are:

a. $Z_s = \mu_\theta \cdot Z_2$
b. $\theta_s = \theta_1 + \Phi_s$
c. $Z_p = Z_1/\mu_\theta$
d. $\theta_p = \theta_2 + \Phi_p$ where $Z_1/\theta_1$ and $Z_2/\theta_2$ are the respective known complex impedances, where $Z_s/\theta_s$ is the unknown series resulant and $Z_p/\theta_p$ is the unknown parallel resultant, and where $\mathrm{Sin}\Phi_s$ or $\mathrm{Sin}\Phi_p = \mathrm{Sin}\theta/\mu\theta$, $\theta$ being defined as equal to the difference between the angles of the two known vectors, i.e. $\theta_1 - \theta_2$.

$\Phi$ may be hence either positive or negative, depending on the relationship between $Z_1/\theta_1$ and $Z_2/\theta_2$, and thus is added to or subtracted from $\theta_1$ or $\theta_2$ in accordance with the above relationships to achieve the respective values of $\theta_s$ and $\theta_p$. For series resultants, when the phasor vector having the larger magnitude also has the larger angle, i.e. $Z_1$ is larger than $Z_2$ and $\theta_1$ is greater than $\theta_2$, $\Phi$ is negative and hence is substracted from $\theta_1$ to achieve $\theta_s$, otherwise, $\Phi$ is positive and added to $\theta_1$ when the phasor vector having the larger magnitude has the smaller angle. Conversely, for parallel resultants, $\Phi$ is positive and is added to $\theta_2$ when the phasor vector having the larger magnitude also has the larger angle, while $\Phi$ is subtracted from $\theta_2$ when the phasor vector having the larger magnitude has the smaller angle.

Since $Z_1$, $Z_2$ and $\theta$, i.e. the absolute difference between $\theta_1$ and $\theta_2$ are known, and since the value of coefficient $\mu_\theta$ may be easily ascertained from the inventor's new slide rule cursor, as will be shown, the values of $Z_p/\theta_p$ and $Z_s/\theta_s$ may be calculated in simple, one-step operations. The theoretical proof of the above relationships will now be briefly reviewed.

Figure 1:
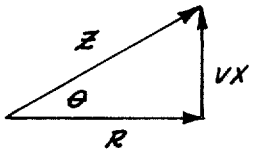
FIG. 1 is a vector diagram showing the relationship between trigonometric vectors and a resultant phasor vector.
Figure 2:
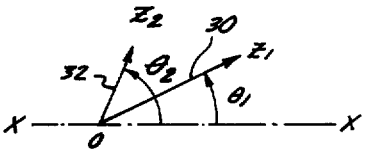
FIG. 2 is a phasor vector diagram showing the relationship of two phasor vectors $Z_1/\eta_1$ and $Z_2/\theta_2$, where $Z_1$ is larger than $Z_2$ and $\theta_2$ is larger than $\theta_1$.
Figure 4:
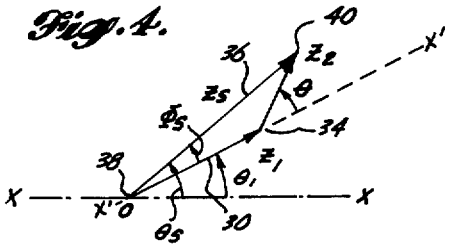
FIG. 4 is a phasor vector diagram showing the vector addition of phasor vectors $Z_1/\theta_1$ and $Z_2/\theta_2$ of FIG. 2.
Figure 5:
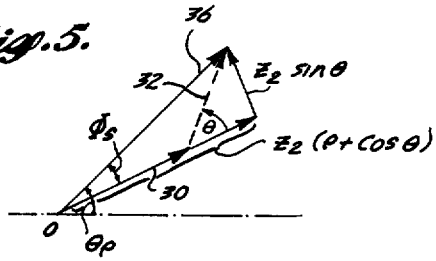
FIG. 5 is a phasor vector diagram showing the vector addition of $Z_1/\theta_1$ and $Z_2/\theta_2$ of FIG. 4 in an expanded form, demonstrating the relationship of angle $\theta$ to the other vectors.

Referring now to FIGS. 2, 4 and 5, phasor vector diagrams are shown with a first phasor vector 30 having a vector magnitude $Z_1$ and a vector angle $\theta_1$, and a second phasor vector 32 having a vector magnitude $Z_2$ and a vector angle $\theta_2$. Thus, in FIGS. 2 and 4, the phasor vector having the larger vector magnitude has the smaller vector angle. A new reference line X'-X' for the phasor vector diagram is first established (FIG. 4) coincident with phasor vector $Z_1/\theta_1$ as a convention because $Z_1$ is less than $Z_2$. Phasor vector $Z_2/\theta_2$ is then moved along the reference line to the tip end 34 of the phasor vector 30, as shown in FIG. 4. Since vector 30 ($Z_1/\theta_1$) is now coincident with the new reference line X'-X', $\theta_2 = \theta$, where $\theta$ has been previously defined as $\theta_2$-$\theta_1$. From conventional vector addition, the phasor vector 36 (FIG. 4) which extends between the tail end 38 of vector 30 and the tip end 40 of vector 32 is the series resultant of vectors 30 and 32. $\Phi$ is defined as the angle between the series resultant vector 36, i.e., $Z_s/\theta_s$ and the reference line X'-X'. Since $\theta_1$ = zero, and $\theta_2 = \theta$, with respect to X'-X', $Z_s/\Phi_s$ by vector addition $= Z_1 + Z_2/\theta = Z_2(Z_1/Z_2 + 1/\theta)$. Z1/Z2 can be now arbitrarily defined as $\rho$.

$$Z_s/\Phi_s \text{ then } = Z_2(\rho + /\theta)$$

$$= Z_2(\rho + \mathrm{Cos}\,\theta + J\mathrm{Sin}\,\theta)$$

$$= Z_2(\rho + \mathrm{Cos}\,\theta) + JZ_2\mathrm{Sin}\,\theta$$

$Z_s/\Phi_s$ has at this point now been defined as a combination of a real quantity ($Z_2[\rho + \mathrm{Cos}\,\theta]$) and an imaginary quantity ($JZ_2\mathrm{Sin}\,\theta$). These components are plotted in trigonometric vector form in FIG. 5. Under conventional mathematical principles concerned with the solution of complex impedances, $$Z_s = [(\text{real})^2 + (\text{imaginary})^2]^{1/2}$$

$$Z_s = [[Z_2(\rho + \mathrm{Cos}\,\theta)]^2 + (Z_2\,\mathrm{Sin}\,\theta)^2]^{1/2}$$

$$Z_s = Z_2[\rho^2 + 2\rho\text{Cos}\,\theta + \text{Cos}^2\theta + \text{Sin}^2\theta]^{1/2}$$

$$Z_s = Z_2[\rho^2 + 2\,\text{Cos}\,\theta + 1]^{1/2}$$

Now, if the expression $\rho^2 + 2\,\text{Cos}\,\theta + 1$ is defined as $\mu_\theta^2$, the above formula reduces to $Z_s = Z_2 \cdot \mu\theta$. Referring now to FIG. 5, $$\text{Sin}\,\Phi_s = Z_2\text{Sin}\,\theta/Z_s$$
$$= Z_2\text{Sin}\,\theta/\mu\theta Z_2$$

$$= \text{Sin}\,\theta/\mu\theta$$

Also from FIGS. 4 and 5 and from the above, it is apparent that $\Phi_s$ is positive and hence $$\theta_s = \theta_1 + \Phi_s$$

Figure 6:
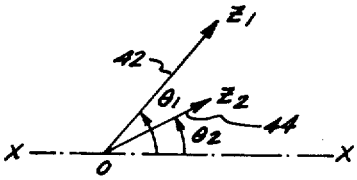
FIG. 6 is a phasor vector diagram showing the relationship of two phasor vectors, $Z_1/\theta_1$ and $Z_2/\theta_2$, where $Z_1$ is larger than $Z_2$ and $\theta_1$ is greater than $\theta_2$.
Figure 7:
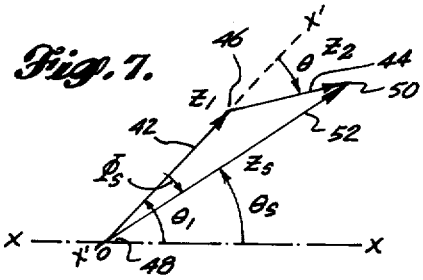
FIG. 7 is a phasor vector diagram showing the vector addition solution for the phasor vectors of FIG. 6.
Figure 8:
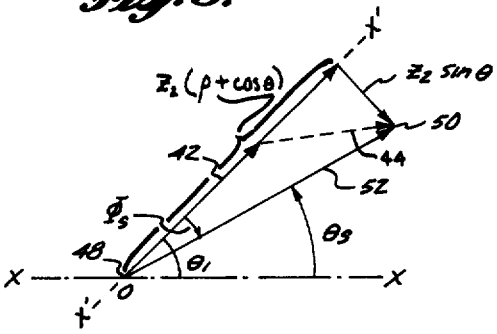
FIG. 8 is a phasor vector diagram showing the vector addition of the phasor vectors of FIG. 6 in an expanded form showing the relationship of angle $\theta$ to the other vectors.

Referring now to FIGS. 6, 7, and 8, phasor vectors 42 and 44 are shown, to demonstrate the $\mu\theta$ coefficient relationships when $Z_1$ is larger than $Z_2$ and $\theta_1$ is greater than $\theta_2$. Since in this instance $Z_1$ is larger than $Z_2$, once again vector $Z_1/\theta_1$ is the new reference line X'-X', as shown in FIG. 7, and vector $Z_2/\theta_2$ is referenced with respect thereto. $\theta_1$ = zero, $\theta_2 = -\theta$ when referred to reference axis X'-X'.

Again, in accordance with conventional geometric principles, vector 44 is moved along the reference line X'-X', maintaining its original angular relationship thereto, until it is at the tip end 46 of vector 42. The vector which now can be drawn to extend from the tail end 48 of vector 42 to the tip end 50 of vector 44 is the series resultant vector 52, i.e. $Z_s/\theta_s$. Since $Z_1$ is larger than $Z_2$ and $\theta_1$ greater than $\theta_2$, $\theta_s$ will always be smaller than $\theta_1$, as shown in FIG. 7, and hence, $\Phi_s$, which is defined as the angle between the reference line X'-X' (coincident with vector 42) and the series resultant vector 52, will be negative and hence its value will be subtracted from $\theta_1$ in such case to obtain $\theta_s$.

Referring now to FIGS. 7 and 8, and following a similar series of calculations and conventions to that noted above, $$Z_s/\Phi_s = Z_1 + Z_2/-\theta$$

$$= Z_2(Z_1/Z_2 + 1/-\theta)$$

$$= Z_2(\rho + /-\theta$$

$$= Z_2(\rho + \text{Cos}\theta - J\text{Sin}\theta)$$

$$= Z_2(\rho + \text{Cos}\theta) - JZ_2\text{Sin}\theta$$

$Z_2(\rho + \text{Cos}\theta)$ is the real portion of the expression and $JZ_2\text{Sin}\theta$ is the imaginary portion. Following conventional principles and referring to FIG. 8, $$Z_s = [[Z_2(\rho + \text{Cos}\,\theta)]^2 + (-Z_2\text{Sin}\,\theta)^2]^{1/2}$$

$$= Z_2[\rho^2 + 2\,\rho\text{Cos}\,\theta + 1]^{1/2}$$

$$= Z_2\mu_\theta,$$

where $\mu\theta^2$, as defined above, equals $\rho^2 + 2\text{Cos}\,\theta + 1$.

Referring again to FIG. 8, for the convention where the new reference axis X'-X' is coincident with $Z_1/\theta_1$, and since $\Phi_s$ will thus be negative $$\text{Sin}\,\Phi_s = \frac{-Z_2\text{Sin}\,\theta}{Z_s}$$

-continued $$= \frac{-Z_2\text{Sin}\,\theta}{\mu_\theta Z_2}$$

$$= \frac{-\text{Sin}\,\theta}{\mu_\theta}.$$

from which $\Phi_s$ can now be readily determined. From FIGS. 7 and 8, and as is clear from the above, $\theta_s = \theta_1 + (-\Phi_s) = \theta_1 - \Phi_s$.

Thus, the resultant values of $Z_s$ and $Z_s/\theta_s$, both for the circumstance when the vector angle of the impedance having the larger magnitude is greater than the vector angle of the impedance having the smaller magnitude, and vice versa, are directly related to their constitutent values of $Z_1/\theta_1$ and $Z_2/\theta_2$ by means of a coefficient $\mu_\theta$, which is defined as being equal to $[\rho^2 + 2\rho\text{Cos}\,\theta + 1]^{1/2}$, where $\rho$ and $\theta$ are defined as above.

In solving for the resultant of two series impedances, the new reference axis X'-X' is always established coincident with the phasor vector having the larger magnitude, or Z term. In series calculations, the larger magnitude phasor vector dominates the magnitude of the resultant, since the magnitude of the resultant will always be larger than the magnitude of the larger constituent phasor vector. Hence, for series resultants, $Z_s/\theta_s$ is referenced with respect to the phasor vector having the larger magnitude and the sign of $\Phi_s$ is determined accordingly.

With parallel impedances, the small impedance dominates, as the magnitude of the resultant of parallel impedances will always be less than the magnitude of the smaller impedance. Hence, $Z_p/\theta_p$ is referenced with respect to the smaller magnitude impedance, and the sign of $\Phi_p$ is determined accordingly.

In those instances where the resultant of two parallel impedances is to be found, there are again two possible vector relationships. In the first relationship, the phasor vector having the larger magnitude (e.g. $Z_1$ is greater than $Z_2$) also has the greater angle (e.g. $\theta_1$ is greater than $\theta_2$). The other relationship is where the phasor vector having the larger magnitude (e.g. $Z_1$ is larger than $Z_2$) has the lesser angle (e.g. $\theta_1$ is less than $\theta_2$).

From conventional circuit theory, the resultant of two parallel impedances is found by adding the inverse of the two vectors representing the impedances. For the circuit of FIG. 2, where $Z_1$ is greater than $Z_2$ and $\theta_1$ is less than $\theta_2$ and where $Z_p/\theta_p$ for reasons noted earlier is referenced to vector 32 (e.g. $Z_2/\theta_2$), $$\frac{1}{Z_p\underline{/\Phi_p}} = \frac{1}{Z_1\underline{/-\theta}} + \frac{1}{Z_2}$$

$$= \frac{Z_2 + Z_1/-\theta}{Z_1Z_2\underline{/-\theta}}$$

$$\therefore Z_p\underline{/\Phi_p} = \frac{Z_1Z_2/-\theta}{Z_2 + Z_1\underline{/-\theta}}$$

$$= \frac{Z_1Z_2/-\theta}{Z_2(1 + \rho\underline{/-\theta}}, \text{ where } \rho = \frac{Z_1}{Z_2}$$

$$= Z_1\frac{/-\theta}{(1 + \rho\underline{/-\theta})}$$

$$= Z_1\frac{(/-\theta)(1 + \rho/\theta)}{(1 + \rho\underline{/-\theta})(1 + \rho\underline{/\theta})}$$

$$= Z_1\frac{/-\theta + \rho}{1 + \rho\underline{/\theta} + \rho\underline{/-\theta} + \rho^2}$$

-continued $$= Z_1 \frac{/-\theta + \rho}{1 + \rho\mathrm{Cos}\theta + J\rho\mathrm{Sin}\theta - \rho\mathrm{Cos}\theta - J\rho\mathrm{Sin}\theta + \rho^2}$$

$$= Z_1 \frac{/-\theta + \rho}{1 + 2\rho\mathrm{Cos}\theta + \rho^2}$$

$$= \frac{Z_1/-\theta + \rho}{\mu_\theta^2}$$

$$= \frac{Z_1}{\mu_\theta^2}[\mathrm{Cos}\theta + \rho + J(-\mathrm{Sin}\theta)]$$

$$= \frac{Z_1}{\mu_\theta^2}[\rho + \mathrm{Cos}\theta] - \frac{JZ_1}{\mu_\theta^2}(\mathrm{Sin}\theta)$$

Figure 9:
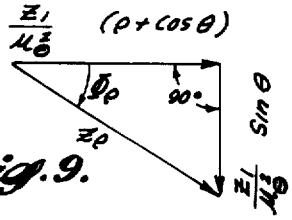
FIG. 9 is a trigonometric and phasor vector diagram showing the real and imaginary components of parallel resultant vector $Z_p/\Phi_p$, where $\Phi_p$ is negative.

The real and imaginary components of the last expression immediately above are plotted in the vector diagram shown in FIG. 9, where the vector $Z_p/\Phi_p$ is the vector resultant. From FIG. 9, and from conventional geometric principles, $$Z_p = \left[\frac{Z^1}{\mu_\theta^2}(\rho + \mathrm{Cos}\theta)^2 + \left(-\frac{Z_1}{\mu_\theta^2}\ \mathrm{Sin}\theta\right)^2\right]^{\frac{1}{2}}$$

$$= \frac{Z_1}{\mu_\theta^2}[(\rho + \mathrm{Cos}\theta)^2 + \mathrm{Sin}^2\theta]^{\frac{1}{2}}$$

$$= \frac{Z_1}{\mu_\theta^2}[(\rho^2 + 2\rho\mathrm{Cos}\theta + 1]^{\frac{1}{2}}$$

$$= \frac{Z_1}{\mu_\theta^2}\cdot\mu_\theta$$

$$= \frac{Z_1}{\mu_\theta}$$

Again referring to Figure 9, $$\mathrm{Sin}\ \Phi_p = \frac{-\frac{Z_1}{\mu_\theta}\mathrm{Sin}\theta}{Z_p}$$

$$\mathrm{Sin}\ \Phi_p = \frac{\frac{Z_1}{\mu_\theta^2}\mathrm{Sin}\ (\theta)}{\frac{Z_1}{\mu_\theta}}$$

$$= \frac{-\mathrm{Sin}\ (\theta)}{\mu_\theta}$$

From the last equation immediately above, $\Phi_p$ can be easily calculated and, referring to FIG. 2, using vector 32 as the reference, as mentioned above, $\theta_p = \theta_2 - \Phi_p$. Thus, once $\mu_\theta$ is known for particular values of $Z_1/\theta_1$ and $Z_2/\theta_2$, $Z_p$ and $\theta_p$ may be readily calculated.

Figure 10:
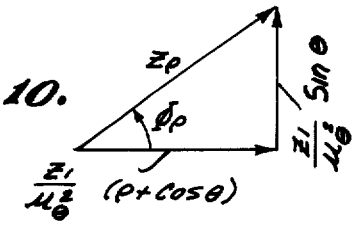
FIG. 10 is a trigonometric and phasor vector diagram showing the real and imaginary component of parallel resultant vector $Z_p/\Phi_p$, where $\Phi_p$ is positive.

FIGS. 6 and 10 concern the resolution of $Z_p/\theta_p$ for the situation when the impedance having the larger magnitude also has the greater angle, i.e. where $Z_1$ is greater than $Z_2$, and $\theta_1$ is greater than $\theta_2$. As with the previous example with respect to ascertaining the resultant of parallel impedances, the vector with the lower magnitude is used as the new reference line for reasons noted above, and since $\theta_2$ is smaller than $\theta_1$, $\Phi_p$ will be positive. Following the solution for the previous example:

$$\frac{1}{Z_p\underline{/\Phi_p}} = \frac{1}{Z_1\underline{/\theta}} + \frac{1}{Z_2}$$

-continued $$= \frac{Z_2 + Z_1/\theta}{Z_1Z_2\underline{/\theta}}$$

$$\therefore Z_p\underline{/\Phi_p} = \frac{Z_1Z_2/\theta}{Z_2 + Z_1\underline{/\theta}}$$

$$= \frac{Z_1Z_2/\theta}{Z_2(1 + \rho\underline{/\theta})}$$

$$= Z_1\frac{/\theta}{(1 + \rho\underline{/\theta})}$$

$$= Z_1\frac{(/\theta)(1 + \rho/-\theta)}{(1 + \rho\underline{/\theta})(1 + \rho\underline{/-\theta})}$$

$$= Z_1\frac{/\theta + \rho}{1 + \rho\underline{/\theta} + \rho\underline{/-\theta} + \rho^2}$$

$$= Z_1\frac{/\theta + \rho}{1 + \rho\mathrm{Cos}\theta + J\rho\mathrm{Sin}\theta + \rho\mathrm{Cos}\theta - J\rho\mathrm{Sin}\theta + \rho^2}$$

$$Z_p\underline{/\Phi_p} = Z_1\frac{/\theta + \rho}{\rho^2 + 2\rho\mathrm{Cos}\theta + 1} = \frac{Z_1}{\mu_\theta^2}(\underline{/\theta} + \rho)$$

$$= \frac{Z_1}{\mu_\theta^2}(\mathrm{Cos}\theta + \rho + J\mathrm{Sin}\theta)$$

$$= \frac{Z_1}{\mu_\theta^2}(\rho + \mathrm{Cos}\theta) + J\frac{Z_1}{\mu_\theta^2}\mathrm{Sin}\theta$$

The real and imaginary portions of the expression immediately above is shown in the vector diagram of FIG. 10. The resultant vector $Z_p$, according to standard principles of trigonometry is ascertained conventionally as follows:

$$= \left[\frac{Z_1}{\mu_\theta^2}(\rho + \mathrm{Cos}\theta)^2 + \left(\frac{Z_1}{\mu_\theta}\mathrm{Sin}\theta\right)^2\right]^{\frac{1}{2}}$$

$$= \frac{Z_1}{\mu_\theta^2}[\rho^2 + 2\rho\mathrm{Cos}\theta + 1]^{\frac{1}{2}}$$

$$= \frac{Z_1}{\mu_\theta^2}\cdot\mu_\theta$$

$$= \frac{Z_1}{\mu_\theta}$$

Referring now to Figure 10, $$\mathrm{Sin}\Phi_p = \frac{\frac{Z_1}{\mu_\theta^2}\mathrm{Sin}\theta}{Z_p}$$

$$= \frac{\frac{Z_1}{\mu_\theta^2}\mathrm{Sin}\theta}{\frac{Z_1}{\mu_\theta}}$$

$$= \frac{\mathrm{Sin}\theta}{\mu_\theta}$$

Once the value of $\mu_\theta$ is obtained, $\Phi_p$ may be ascertained, and then $\theta_p$ may be easily found since, by the formula, $\theta_p = \theta_2 30\ \Phi_p$.

From the above proofs, it can be seen that the coefficient $\mu_\theta$, defined as $[\rho^2 + 2\rho\mathrm{Cos}\theta + 1]^{\frac{1}{2}}$, relates known values of $Z_1/\theta_1$ and $Z_2/\theta_2$ to the resultants $Z_e/\theta_e$ and $Z_p/\theta_p$ for both series and parallel impedances. The value of $\mu_\theta$ depends upon the values of $\rho$ and $\theta$, which are defined above, and which vary with each combination of $Z_1/\theta_1$ and $Z_2/\theta_2$. The value of $\mu_\theta$ may be calculated by hand for each instance in accordance with the definition outlined for $\mu_\theta$.

Figure 11:
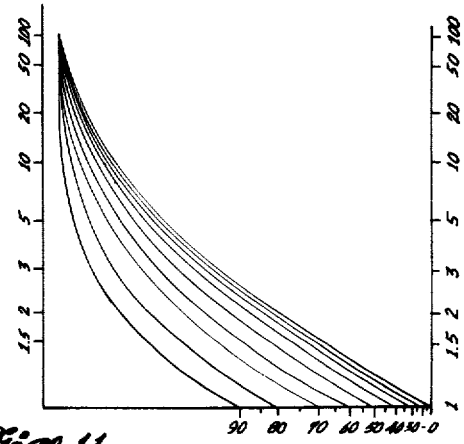
FIG. 11 is a front view showing the face plate portion of the slide rule cursor of the present invention.

The present inventor, however, besides discovering the above discussed relationships between the known values of $Z_1/\theta_1$ and $Z_2/\theta_2$ and the unknown resultants $Z_s/\theta_s$ and $Z_p/\theta_p$ and developing the coefficient $\mu_\theta$, has developed a slide rule cursor having a series of specially adapted curves located thereon, which cursor, when properly manipulated in relation to the body of the slide rule, provides a simple direct read out of $\mu_\theta$ for given values of $Z_1/\theta_1$ and $Z_2/\theta_2$. Such a cursor is shown in FIG. 11. To obtain the curves, the inventor made a large number of hand calculations of $\mu_\theta$ for various values of $\rho$ and $\theta$.

This data was extrapolated into a series of curves, such as shown in the cursor of FIG. 11, with each curve therein representing a value of $\theta$, with the Y axis representing values of $\rho$ and the X axis providing a direct read out of $\mu_\theta$. The series of curves are scaled to fit the slide rule on which the cursor is to be used. The values of $\mu_\theta$ along the X axis of the cursor are scaled in log, to conform to the A scale of the slide rule off which the value is read, while the values of $\rho$ arranged on the Y axis were more conveniently scaled to provide an adequate range of values of $\rho$ in a relatively small vertical space.

Figure 12:
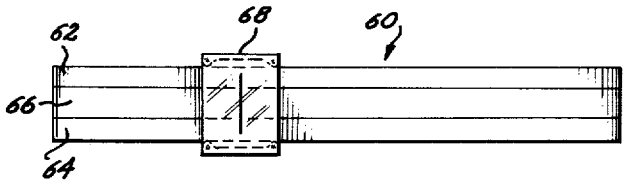
FIG. 12 is a front view showing the slide rule cursor of the present invention operatively positioned on a lineal slide rule.
Figure 13:
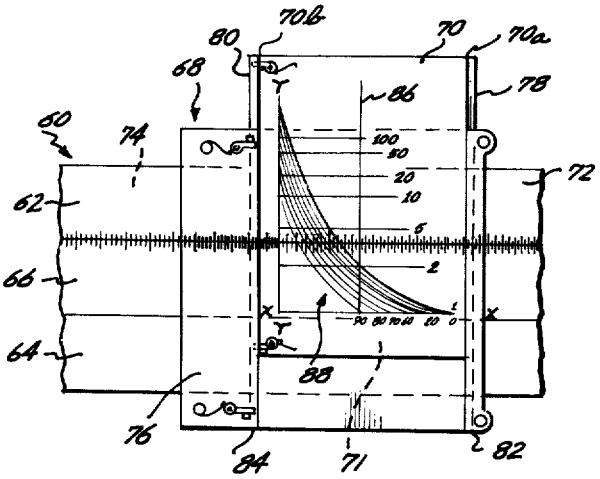
FIG. 13 is a close-up view of a portion of FIG. 12 showing the slide rule cursor of the present invention positioned on a lineal slide rule, with the cursor shown in a partially extended position away from the axis of the rule.

A combination of the new cursor and a lineal slide rule is shown in FIGS. 12 and 13, with the slide rule body 60 comprised conventionally of two fixed portions 62 and 64, and an intermediate slider portion 66. The two fixed portions 62 and 64 and sliding portion 66 all have conventional slide rule scales printed thereon in standard fashion. For purposes of ascertaining $\mu_\theta$ by the present slide rule cursor, however, only scales A and B of a conventional slide rule are necessary. Furthermore, the curves of the cursor may be adapted to accommodate specialized slide rule scales, if necessary. The slide rule cursor itself 68 is conventional in structure and includes at least one and in most instances, two, thin, transparent face plates 70 and 71 which are positioned flat adjacent opposite sides 72 and 74 of the slide rule body 60. For a twelve inch slide rule, each face plate is approximately two inches wide and four inches high. The two face plates are attached to and supported by the supporting structure 76 of the cursor 68, which holds the face plates 70 and 71 in a conventional manner so that the cursor 68 may be conveniently moved axially along the body of rule by the user.

Face plate 70, which includes the $\mu_\theta$ curves, is adapted so as to move laterally of the rule, as shown in FIG. 13. Along each side 70*a* and 70*b* of face plate 70 are projections 78 and 80, which slidably mate with matching grooves 82 and 84 in the supporting structure 76 of cursor 68. This arrangement permits face plate 70 to be moved laterally of the body of the slide rule. A locking means (not shown) may be provided with cursor 68 to lock face plate 70 in a selected lateral position. Face plate 70 will typically have a straight vertical line 86, transverse of the body of the rule, positioned thereon so that conventional slide rule operations can be performed with the new slide rule cursor.

The set of $\mu_\theta$ curves 88 are imprinted on face plate 70 relative to X and Y coordinate axes, as shown in FIG. 11. Referring to FIG. 11, each curve in the set 88 represents one value of $\theta$, which, as noted above, is the absolute difference between $\theta_1$ and $\theta_2$, and which in the set of curves 88 varies from 0° to 120° in increments of 10°. Values of $\theta$ between the curves in set 88 can of course be interpolated. Other sets of curves, to include fewer or more curves can be drawn according to the principles of the present invention. Typically, the number of curves used depends on the space available on face plate 70.

With each curve representing a particular value of $\theta$, the Y axis represents the value of $\rho$, which as stated above, is defined as $Z_1/Z_2$, with $Z_1$ being defined as the larger magnitude. Values of $\rho$ of from 0 - 100 may be accommodated on the cursor of FIG. 13. These values are sufficient to include a wide range of $\rho$ and will probably encompass most, if not all, actual impedance problems. Other ranges of $\rho$ may of course, be used, according to the need of the user. The scale of $\rho$ from 0 - 100 is arbitrary and depends both on the space available on the cursor and the range of $\rho$ desired. In the cursor shown in FIGS. 13-17, the scale is such that values of $\rho$ of between 0 and 100 are accommodated in a vertical space of two inches. To accomplish a useful distribution of values of $\rho$ within that space an arbitrary scale of $Y = 1/\rho \cdot 302$ is used.

This results in a scale factor along the Y axis such that the majority of the vertical space is used for lower values of $\rho$ (e.g. 1/2 of the vertical space is used for $\rho$ = 1 through $\rho$ = 5), while still preserving space for larger values of $\rho$ (e.g. up to $\rho$ = 100). It should be emphasized, however, that this scale factor of $Y = 1/\rho \cdot 302$ for the cursor of FIGS. 13-17 is arbitrary and may vary within the scope of the present invention, depending upon the space available on the slide rule to be used as well as the anticipated range of values of $\rho$.

Figure 14:
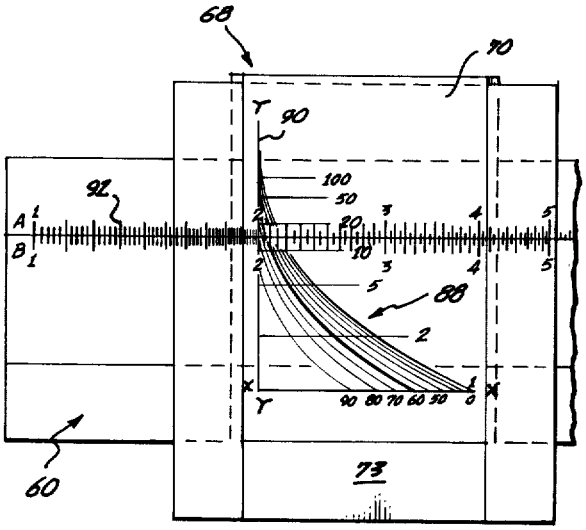
FIG. 14 is a front view showing the slide rule cursor of the present invention in correct position for the first step in determining $\mu_\theta$ for a first $Z_1/\theta_1$ and $Z_2\theta_2$.

The X axis represents values of $\mu_\theta/\rho$, and the scale for the X axis is a conventional log plot with $X = \log \mu_{\theta/\rho}$. The log scale for the X axis was chosen to conform to the log scale used on the body of the slide rule (e.g. the A scale on a conventional slide rule, so that values of $\mu_\theta$ may be directly ascertained from the fixed rule scale for given values of $\rho$ and $\theta$. This physical arrangement of the set of curves 88, its scaling, and the relationship of the curves to the scales of the body of the rule will be clarified by actual examples. As a first example, assume for two given impedances that $\rho$ = 2, and $\theta$ = 60°, i.e. $Z_1$ is twice as large as $Z_2$, and the absolute difference between $\theta_1$ and $\theta_2$ is 60°. Referring now to FIG. 14, the first step in determining $\mu_\theta$ from the slide rule, with a $\rho$ of 2 and a $\theta$ of 60°, the cursor 68 is moved axially along the body of the slide rule 60 until the Y axis line 90 is coincident with the correct value of $\rho$ (e.g.2) on the A scale of the body of the slide rule.

Figure 15:
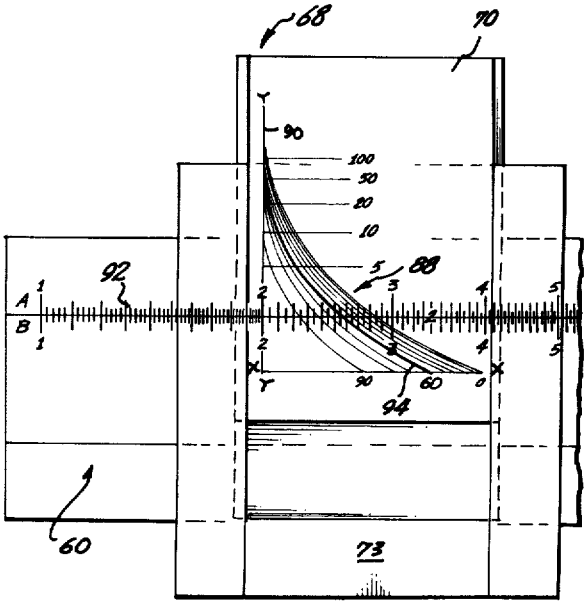
FIG. 15 is a front view showing the slide rule cursor of the present invention in correct position for the second and final step in determining $\mu_\theta$ for the example of FIG. 14.

Typically, the face plate 70 is resting against stop 73 when this first axial move is accomplished. After completion of the first step, the Y axis line 90 is coincident with the $\rho$ value of 2 on the A scale of the slide rule. The $\rho$ value of 2 is thus the reference line for further cursor manipulations, with the A scale of the body of the slide rule 68 being, as stated above, identical to the scale of the X axis of the $\mu_\theta$ curve set 88 of cursor 68. The second manipulative step of the slide rule for the first example is shown in FIG. 15, wherein the face plate 70 of cursor 68 is moved laterally upward of the axial direction of the body of the slide rule, with Y axis line 90 remaining coincident with the value of 2 on the A scale, until the actual value of $\rho$ , e.g. 2, on the Y axis of the cursor curves is coincident with the base of the A scale on the body of the slide rule. When the face plate 70 is in this operative position, the one particular cursor curve 94 in the set 88 which corresponds to the actual value of $\theta$ for the two impedances under consideration, e.g. $\theta = 60°$, is then identified. The point at which the curve crosses the A scale axis 92 is then next identified. The value of $\mu_\theta$ may be read directly off the A scale. AS seen from FIG. 14, curve 94, which corresponds to $\theta = 60°$, crosses the X axis 92 at a value of 2.66, which is the value of $\mu_\theta$ when $\rho = 2$ and $\theta = 60°$.

The accuracy of the value of $\mu_\theta$ as read from the slide rule for given values of $\rho$ and $\theta$ depends upon accurately establishing the Y axis line 90 coincident with the value of $\rho$ on the A scale of the slide rule, on positioning the movable face plate 70 accurately laterally, and on accurately reading the crossing point of the correct $\theta$ curve (or interpolating between them as necessary) with respect to the A scale axis 92.

Figure 16:
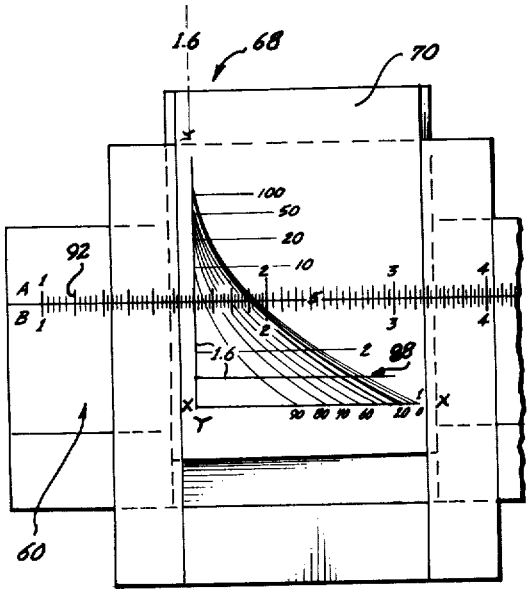
FIG. 16 is a front view showing the slide rule cursor of the present invention in correct position for the first step in determining $\mu\theta$ for a second $Z_1/\theta_1$ and $Z_2/\theta_2$.
Figure 17:
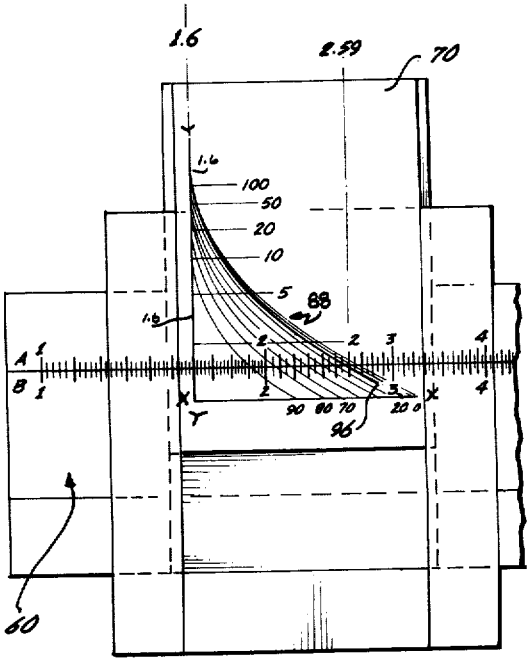
FIG. 17 is a front view showing the slide rule cursor of the present invention in correct position for the second and final step in determining $\mu_\theta$ for the example of FIG. 16.

Referring now to FIG. 61 and 17, another example is shown for a $\rho$ of 1.6 and a $\theta$ of 20°. As shown in FIG. 16, in the first step, the Y axis (line 90) of the cursor is set coincident with 1.6 on the A scale of the slide rule. Referring now to FIG. 17, in the second step, the face plate 70 of the cursor is them moved laterally upwardly, until the value of 1.6, on the Y axis of the cursor is coincident with the base line 92 of the A scale of the slide rule. The value of $\mu_\theta$ for a $\rho$ of 1.6 and a $\theta$ of 20° is then found by following curve 96, which is the $\theta =$ 20 curve until it crosses the base line of the A axis 92. The point at which it crosses the base line is 2.54, which is the value of $\mu_\theta$ for a $\rho$ of 1.6 and a $\theta$ of 20°.

As explained above in some detail, once the value of $\mu_\theta$ has been ascertained, the values of the magnitude and angle of the resultant of both series impedances and parallel impedances may be readily accomplished in one step operations in accordance with the relationships explained and proven above.

In summary, the inventor has developed a set of relatively simple relationships which relates values of $Z_1$, $Z_2$, $\theta_1$, and $\theta_2$ to the values of series and parallel resultants $Z_s$, $Z_p$, $\theta_s$ and $\theta_p$ through a complex expression referred to as a $\nu_\theta$, which has a unique value for each set of $Z_1/\theta_1$ and $Z_2/\theta_2$.

Furthermore, by performing a number of calculations for $\mu_\theta$ for selected values of $\rho$ and $\theta$, and then scaling the results to correspond to convention slide rules, the inventor has developed a set of $\mu_\theta$ curves which have in turn been positioned on one face plate of a slide rule cursor. By manipulating the cursor in a particular manner for specified values of $\rho$ and $\theta$, the corresponding value of $\mu_\theta$ may be easily ascertained directly from the slide rule. The curves on the new cursor may vary in scale, depending on the slide rule to which the cursor is adapted and the desired scale for the Y axis.

The use of such a cursor to ascertain $\mu_\theta$, and the attendant relationships between $\mu_\theta$ and the resultants $Z_s/\theta_s$ and $Z_p/\theta_r$, permit accurate and fast resolution of those resultants of complex impedances, while eliminating the laborious and lengthy calculations proviously necessary for such resolution.

It should be recognized that other modifications and changes may be made in the embodiment of the present invention shown and described, without departing from the spirit of the invention which is defined by the claims which follow.

What is claimed is:

1. A cursor for slide rules, said cursor being adapted for use in association with a selected scale on the slide rule to determine a vector coefficient $\mu_\theta$ which in turn is useful for computing the resultant of two known complex impedances when said two complex impedances are expressed in phasor vector form, wherein the ratio of the magnitudes of said two complex impedances is defined as $\rho$, the absolute difference between their angles is defined as $\theta$, and $\mu_\theta$ is defined as $(\rho^2 + 2\rho\text{Cos}\theta + 1)^{1/2}$, said cursor comprising:

a. cursor face plate means having displayed on one surface thereof first and second co-ordinate axes and at least one coefficient curve defined relative thereto, said first co-ordinate axis representing values of $\rho$, said second co-ordinate axis representing values of $\mu_\theta$, and said coefficient curve being a precalculated locus of points relating $\mu_\theta$ to $\rho$ for one selected value of $\theta$; and b. cursor frame means for holding said face plate means in operative relationship with said slide rule and adapted to permit movement of said face plate means along said selected scale of the slide rule, said frame means further including means permitting movement of said face plate means perpendicular to said selected scale, said second co-ordinte axis and hence said coefficient curve being so scaled and arranged relative to the selected scale on the slide rule that, in operation to determine $\mu_\theta$ for two selected complex impedances, i. said face plate means is first positioned such that said first co-ordinate axis passes through the value of $\rho$ on said selected scale for said two selected complex impedances, and ii. said face plate means is then moved sufficiently perpendicularly that said selected scale passes through said value of $\rho$ on said first co-ordinate axis, such positioning of said face plate means resulting in said coefficient curve passing through the correct value of $\mu_\theta$ on said selected scale for said two selected complex impedances, said value of $\mu_\theta$ being useful to calculate the resultant of said two selected complex impedances.

2. An apparatus of claim 1, wherein the second coordinate axis has a scale factor of $Y = 1/\rho^3$.

3. An apparatus of claim 1, wherein said face plate means has displayed on said one surface thereof a plurality of coefficient curves, each of said coefficient curves corresponding uniquely to a selected value of $\theta$.

4. An apparatus of claim 1, wherein said frame means includes stop means for positioning said face plate means in a first position relative to said frame means.

5. An apparatus of claim 4, wherein said means permitting movement includes means for yieldably biasing said face plate means in said first position.

6. A slide rule for determining a vector coefficient $\mu_\theta$ which in turn is useful in computing the resultant of two known complex impedances when said two complex impedances are expressed in phasor vector form, wherein the ratio of the magnitudes of said two complex impedances is defined as $\rho$, the absolute difference between their angles is defined as $\theta$, and $\mu_\theta$ is defined as $(\rho^2 + 2\rho\text{Cos}\theta + 1)^{1/2}$ said slide rule comprising:

a. a slide rule body having at least one selected scale displayed thereon;

b. cursor face plate means having displayed on one surface thereof first and second co-ordinate axes and at least one coefficient curve defined relative thereto, said first coordinate axis representing values of $\rho$, said second co-ordinate axis representing values of $\mu_\theta$, and said coefficient curve being a precalculated locus of points relating $\mu_\theta$ to $\rho$ for one selected value of $\theta$; and c. cursor frame means for holding said face plate means in operative relationship with said slide rule body and adapted to permit movement of said face plate means therealong in the direction of said selected scale, said frame means further including means permitting movement of said face plate means perpendicular to said selected scale, said second co-ordinate axis and hence said coefficient curve being so scaled and arranged relative to said selected scale on said slide rule body that, in operation to determine $\mu_\theta$ for two selected complex impedances, i. said face plate means is first positioned such that said first co-ordinate axis passes through the value of $\rho$ on said selected scale for said two select complex impedances, and ii. said face plate means is then moved sufficiently perpendicularly that said selected scale passes through said value of $\rho$ on said first coordinate axis, such positioning of said face plate means resulting in said coefficient curve passing through the correct value of $\mu_\theta$ on said selected scale for said two selected complex impedances, said value of $\mu_\theta$ being useful to calculate the resultant of said two selected complex impedances.

* * * * *